US009506255B1

(12) United States Patent
Jones et al.

(10) Patent No.: US 9,506,255 B1
(45) Date of Patent: Nov. 29, 2016

(54) MODULAR FLOORING DEVICE AND SYSTEM

(71) Applicants: Chad H. Jones, Frisco, TX (US); Andrew Sneeringer, St. Cloud, FL (US); Andrew Wolff, Livonia, MI (US); Daniel Himes, Shelby, MI (US); Bart Berghuis, Rockledge, FL (US)

(72) Inventors: Chad H. Jones, Frisco, TX (US); Andrew Sneeringer, St. Cloud, FL (US); Andrew Wolff, Livonia, MI (US); Daniel Himes, Shelby, MI (US); Bart Berghuis, Rockledge, FL (US)

(73) Assignee: Signature Systems Group, LLC, Flower Mound, TX (US)

( * ) Notice: Subject to any disclaimer, the term of this patent is extended or adjusted under 35 U.S.C. 154(b) by 0 days.

(21) Appl. No.: 14/918,061

(22) Filed: Oct. 20, 2015

(51) Int. Cl.

| | |
|---|---|
| ***E04F 15/00*** | (2006.01) |
| ***E04F 15/02*** | (2006.01) |
| *E01C 9/08* | (2006.01) |
| *E01C 5/20* | (2006.01) |

(52) U.S. Cl.
CPC ... *E04F 15/02022* (2013.01); *E04F 15/02172* (2013.01); *E01C 5/20* (2013.01); *E01C 9/086* (2013.01); *E04F 2203/06* (2013.01)

(58) Field of Classification Search
CPC ..... E04F 2203/06; E04F 15/02022; E04F 15/02172; E01C 9/086; E01C 5/20
See application file for complete search history.

(56) References Cited

U.S. PATENT DOCUMENTS

| | | | | |
|---|---|---|---|---|
| 1,977,496 A | | 10/1934 | Snyder et al. | |
| 3,397,496 A | | 8/1968 | Sohns | |
| 3,964,221 A | | 6/1976 | Berquist | |
| 4,198,795 A | | 4/1980 | Barnidge | |
| 4,238,181 A | | 12/1980 | Dannels et al. | |
| 4,436,779 A | | 3/1984 | Menconi et al. | |
| 4,629,358 A | * | 12/1986 | Springston | E01C 5/22 404/35 |
| 4,840,825 A | | 6/1989 | Aristodimou | |
| 4,988,131 A | | 1/1991 | Wilson et al. | |
| 5,364,204 A | | 11/1994 | MacLeod | |
| 5,403,063 A | | 4/1995 | Sjostedt et al. | |

(Continued)

FOREIGN PATENT DOCUMENTS

| | | |
|---|---|---|
| DE | 20209502 U1 | 10/2002 |
| EP | 1913213 A1 | 4/2008 |

(Continued)

OTHER PUBLICATIONS

International Searching Authority; International Search Report and Written Opinion of the International Searching Authority; International Application No. PCT/US2013/58130; Patent Cooperation Treaty; pp. 1-10; publisher United States Patent Office; Published Alexandria, Virginia, USA; copyright and mailing date Jan. 16, 2014; copy enclosed (10 pages).

(Continued)

*Primary Examiner* — Andrew J Triggs
(74) *Attorney, Agent, or Firm* — Metz Lewis Brodman Must O'Keefe LLC

(57) ABSTRACT

A modular mat comprises mirror image layers. At least one fitting receiver is integrally formed in a central portion of each layer, and at least one aperture is formed in a flange portion of each layer. The layers are congruently mated and affixed such that the fitting receiver of one layer is disposed through a corresponding aperture of the flange of the opposite layer. The outer surfaces of the layers comprise traction elements, which may be of different grades, such as industrial grade on one layer and pedestrian grade on the opposing layer. A floor covering system is also disclosed comprising a plurality of modular mats disposed in partially overlapping and interlocking relation with adjacent mats.

40 Claims, 16 Drawing Sheets

(56) References Cited

U.S. PATENT DOCUMENTS 5,407,342 A 4/1995 Boucher et al.
5,427,558 A 6/1995 Knudsen et al.
5,469,999 A 11/1995 Phirippidis
5,630,304 A 5/1997 Austin
5,653,551 A * 8/1997 Seaux ..... E01C 5/18 404/35
5,833,386 A 11/1998 Rosan et al.
5,992,106 A 11/1999 Carling et al.
6,032,428 A 3/2000 Rosan et al.
6,098,354 A 8/2000 Skandis
6,220,785 B1 4/2001 Kennedy et al.
6,245,415 B1 6/2001 Keller et al.
6,282,858 B1 9/2001 Swick
6,455,127 B1 9/2002 Valtanen
6,511,257 B1 * 1/2003 Seaux ..... E01C 9/086 404/34
6,554,604 B1 4/2003 Schmidt
6,564,522 B1 5/2003 Chiu-Ying
6,649,110 B1 11/2003 Seaux et al.
6,662,508 B1 12/2003 Else
6,684,582 B2 2/2004 Peart et al.
6,685,388 B2 * 2/2004 Webster ..... E01C 5/20 403/408.1
6,695,527 B2 * 2/2004 Seaux ..... E01C 9/086 404/34
6,719,551 B2 4/2004 Polk, Jr.
6,869,558 B2 3/2005 Polk, Jr.
6,900,547 B2 5/2005 Polk, Jr.
6,909,373 B2 6/2005 Power et al.
7,208,219 B2 4/2007 Polk, Jr.
7,303,800 B2 * 12/2007 Rogers ..... B32B 3/02 404/34
7,413,374 B2 * 8/2008 Rogers ..... E01C 9/086 404/35
7,607,265 B2 10/2009 Curry et al.
7,621,092 B2 11/2009 Groeke et al.
7,779,595 B2 8/2010 Polk, Jr.
7,837,917 B2 11/2010 Polk, Jr.
7,842,225 B2 11/2010 Polk, Jr.
7,842,226 B2 11/2010 Polk, Jr.
7,914,228 B2 3/2011 Rapaz
7,923,095 B2 4/2011 Polk, Jr.
7,931,845 B2 4/2011 Polk, Jr.
7,955,550 B2 6/2011 Polk, Jr.
8,070,471 B2 12/2011 Polk, Jr.
8,936,374 B1 * 1/2015 Royse ..... F21V 33/006 362/153
9,249,570 B2 * 2/2016 Jean ..... E04B 5/023
9,337,586 B2 * 5/2016 McDowell ..... E01C 9/08
2002/0059764 A1 5/2002 Schluter
2002/0084543 A1 7/2002 Buja
2002/0192024 A1 * 12/2002 Webster ..... E01C 5/20 404/41
2003/0113162 A1 * 6/2003 Seaux ..... E01C 9/086 404/35
2003/0197296 A1 10/2003 Krassilnikov
2004/0005430 A1 * 1/2004 Rogers ..... B32B 3/02 428/44
2004/0216250 A1 11/2004 Dumlao et al.
2004/0258869 A1 12/2004 Walker
2006/0070314 A1 4/2006 Jenkins et al.
2006/0159793 A1 7/2006 Hahn et al.
2006/0265975 A1 11/2006 Geffe
2007/0079569 A1 4/2007 Curry et al.
2007/0102243 A1 * 5/2007 Ruminski ..... E01C 5/20 182/222
2007/0108668 A1 5/2007 Hutchinson et al.
2007/0113492 A1 5/2007 Dickey et al.
2007/0137129 A1 6/2007 Sondermann
2007/0261317 A1 11/2007 Moller, Jr.
2007/0280782 A1 * 12/2007 Rogers ..... E01C 9/086 404/35
2008/0127593 A1 6/2008 Janesky
2009/0308002 A1 12/2009 Curry et al.
2011/0097489 A1 4/2011 Kerr et al.
2011/0193253 A1 8/2011 Polk et al.
2011/0277926 A1 11/2011 Polk, Jr.
2012/0266549 A1 * 10/2012 Rosan ..... E01C 11/24 52/173.1
2014/0137505 A1 * 5/2014 Jean ..... E04B 5/023 52/588.1
2016/0017547 A1 * 1/2016 Bordelon ..... B29D 99/0057 404/47
2016/0076204 A1 * 3/2016 McDowell ..... F16J 15/10 277/312

FOREIGN PATENT DOCUMENTS

GB 2256023 A 11/1992
WO WO9220885 A1 11/1992

OTHER PUBLICATIONS

International Searching Authority; International Search Report and Written Opinion of the International Searching Authority; International Application No. PCT/US2010/36218; Patent Cooperation Treaty; pp. 1-8; publisher United States Patent Office; Published Alexandria, Virginia, USA; copyright and mailing date Aug. 2, 2010; (8 pages).

International Searching Authority; International Search Report and Written Opinion of the International Searching Authority; International Application No. PCT/US2012/034220; Patent Cooperation Treaty; pp. 1-8; publisher United States Patent Office; Published Alexandria, Virginia, USA; copyright and mailing date Jul. 3, 2012; (8 pages).

Great Britain Intellectual Property Offce; Examination Report Under Section 18(3); Examination Report from Great Britain Patent Application No. GB1122129.8; copyright and mailing date May 27, 2015; pp. 1-5; publisher Great Britain Intellectual Property Office; Published Newport, South Wales; copyright and mailing date May 27, 2015; (5 pages).

Great Britain Intellectual Property Offce; Examination Report Under Section 18(3); Examination Report from Great Britain Patent Application No. GB1122129.8; copyright and mailing date Jan. 20, 2015; pp. 1-5; publisher Great Britain Intellectual Property Office; Published Newport, South Wales; copyright and mailing date Jan. 20, 2015; (5 pages).

European Patent Office; Extended European Search Report from European Application No. 12774404.3; copyright and mailing date Jul. 30, 2014; pp. 1-6; publisher European Patent Office; Published Munich, Germany; copyright and mailing date Jul. 30, 2014; (6 pages).

* cited by examiner

MODULAR FLOORING DEVICE AND SYSTEM

BACKGROUND OF THE INVENTION

Field of the Invention

This invention relates to modular flooring and roadway mats and systems. More in particular, it relates to dual-sided modular floor mats of uniform construction for ease of installation, durability, strength and use in industrial applications.

Description of the Prior Art

Modular flooring systems of various designs have been utilized for a significant period of time to provide a temporary and rigid surface in remote or inaccessible areas. Such systems are primarily utilized in settings where a firm and stable surface is temporarily needed, such as industrial or construction areas. With respect to industrial or construction areas, temporary flooring may be utilized to provide walkways, driveways, parking areas or other rigid surfaces for the transport of materials, vehicles, storage or mounting of equipment. The modular nature of such flooring is utilized to adapt the flooring to the particular topographic or geographic needs of the particular site and to also allow for the efficient storage and transport of the modular flooring. Pedestrian applications of modular flooring systems also exist, such as the construction of a temporary floor to accommodate a large number of people, such as at a convention or gathering. Pedestrian modular flooring systems may also be used at construction sites, such as to accommodate safe walking paths for workers through an industrial work zone.

In operation, the selection of the particular floor mat and its characteristics are primarily based upon the amount of load expected to be exerted on the modular flooring system, as well as the relative support characteristics of the underlying substrate be it concrete, artificial turf, grass, dirt, or the like. Heavy construction applications require mats with higher strength and resistance to cracking and breaking. Pedestrian grade walkways, on the other hand, do not require the same level of strength and durability as industrial grade applications. The heavier duty mats needed for industrial use are often too heavy and cumbersome for use in pedestrian applications, and the lighter pedestrian grade modular mats are insufficient in strength and ruggedness for an industrial site. However, both are often needed at the same site or location. Existing modular flooring systems use one or the other grade of mat, and therefore are faced with inadequate or incorrect flooring for at least some of the desired applications. This is not only inconvenient, but can lead to safety and liability issues.

Because of the high costs associated with operations in remote areas, installation and removal of modular floor mats must be accomplished quickly. Current ground protective surfaces are constructed by linking a number of units together with a plurality of connectors. These connectors often involve multiple components, such as bolts and screws, which must interact cooperatively to secure the units together. This requires a number of connecting parts to also be hauled to the operation site, and if there are not an even number of parts, then insufficient numbers of connections may be made.

There remains a need, therefore, in the art of modular flooring, for a modular flooring mat and system which maintains a high strength and durability necessary for heavy loads of industrial applications, but is also suitable for lighter pedestrian traffic as often also exists at remote operational sites. There is also a need for a modular floor system which assembles quickly and with as few additional pieces as possible.

SUMMARY OF THE INVENTION

A modular mat for use in constructing a modular flooring system and such flooring system are disclosed. The modular mat is dual sided to support either heavy industrial-strength loads or less weighty pedestrian traffic, while providing stability and ground protection. Each mat is comprised of two layers which are mirror images of one another and which are congruently mated and affixed together along their inner surfaces. Each layer of the mat includes a central core area and a flange portion, such that when the layers are joined together an overall central core area and flange are formed in the mat. Notably, the layers are not offset from one another, but rather are congruent with each other. The resulting flange formed in the mat is therefore a part of the mat itself, and not an offset or overhang.

The layers of the modular mat include a reinforcing structure formed of reinforcing ribs and spaces defined therein. This reinforcing structure imparts the strength and durability needed for industrial applications, while reducing the amount of material needed so the mats may be light enough to also use for pedestrian applications.

The floor covering system is formed by overlapping a part of a central core area of one mat with a flange of another adjacent mat. Each mat also has a fitting receiver integrally formed in the edges which overlap with corresponding fitting receivers on adjacent mats. A locking pin may be inserted through the aligned fitting receivers of the overlapping mats to secure adjacent mats together. The system may be expanded in any direction desired.

Each mat also includes a plurality of traction elements disposed on the outer surfaces of the mats. One side of the mat may have industrial grade traction elements for facilitating the moving of heavy duty loads across the flooring system. The opposite side of the mat may have pedestrian grade traction elements for ease and safety of pedestrian foot traffic.

The mat and mat system, together with their particular features and advantages, will become more apparent from the following detailed description and with reference to the appended drawings.

DESCRIPTION OF THE DRAWINGS

Like reference numerals refer to like parts throughout the several views of the drawings.

DESCRIPTION OF THE PREFERRED EMBODIMENTS

As shown in the accompanying drawings, the present invention is directed to a modular mat 10 for a floor covering and system 100 comprised of a plurality of such modular floor mats 10. As shown throughout the Figures, and with particular reference to FIGS. 1-4, the modular mat 10 of the present invention is comprised of dual layers which, when affixed together, are entirely congruent with each other and produce no offset portion. The two opposing layers of the mat 10 may further provide a dual surface, having different surface patterns to support both heavy weight, industrial applications, such as equipment, as well as less demanding loads, such as personnel or pedestrians. The mat 10 may be of any suitable dimension that renders the building of a temporary floor covering system, as described further herein. In at least one embodiment, each mat 10 measures approximately 10 feet long by 7.5 feet wide, although it should be understood that any suitable dimensions may be used.

Figure 1:
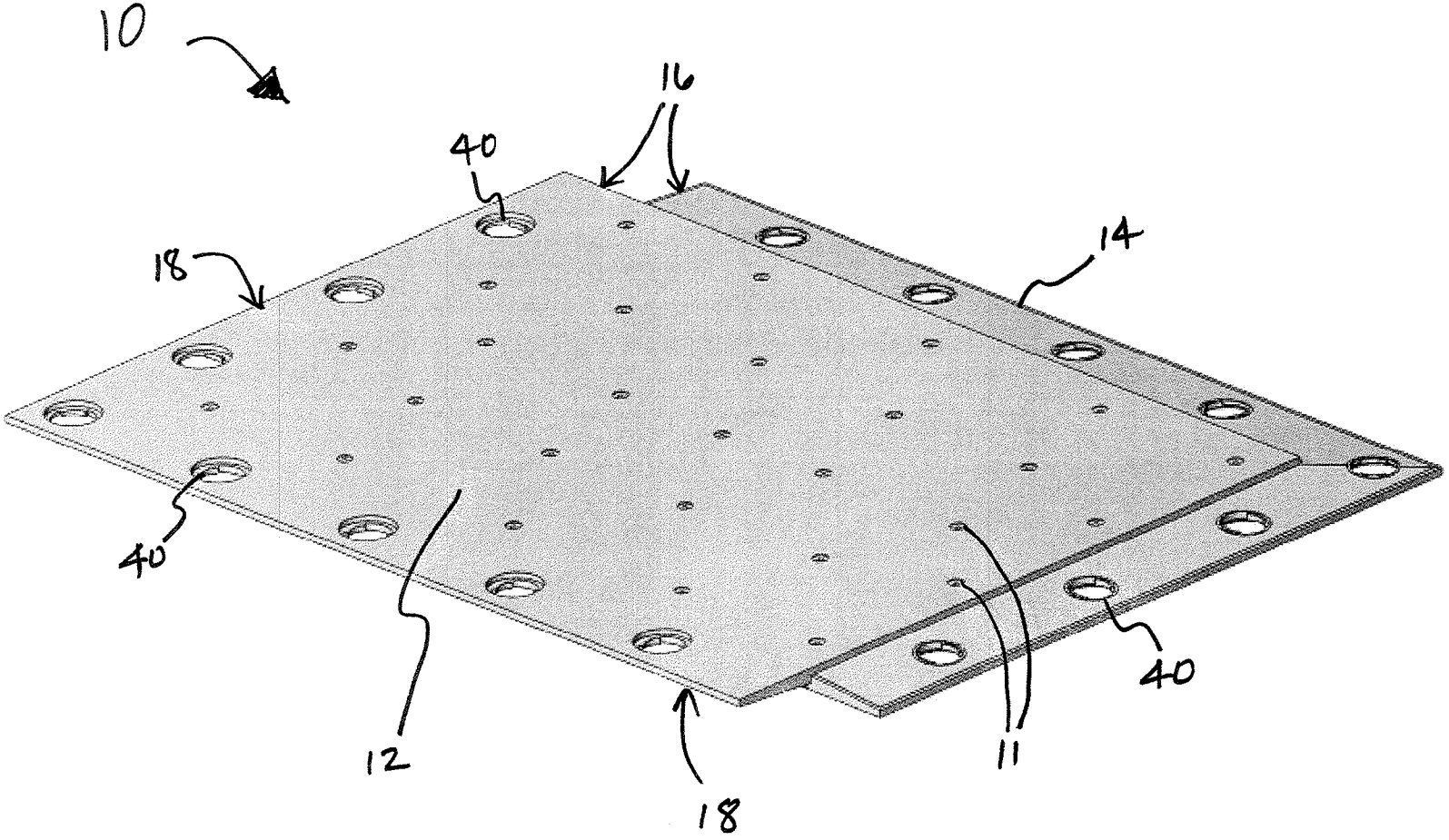
FIG. 1 is an isometric view of the modular mat of the present invention.
Figure 3:
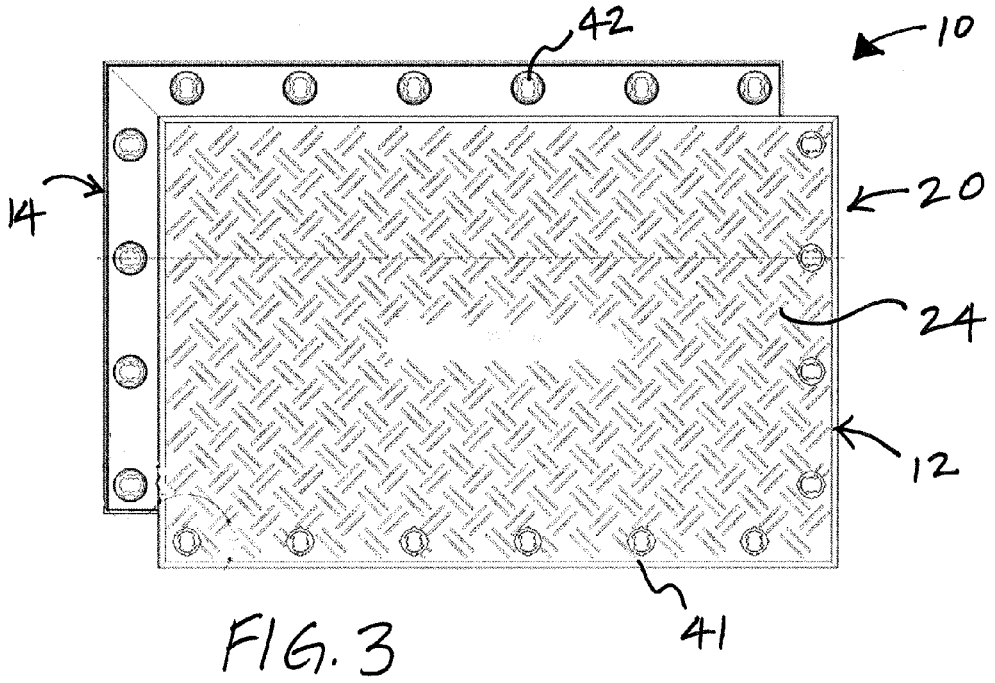
FIG. 3 is a plan view of one side of the modular mat of the present invention.
Figure 4:
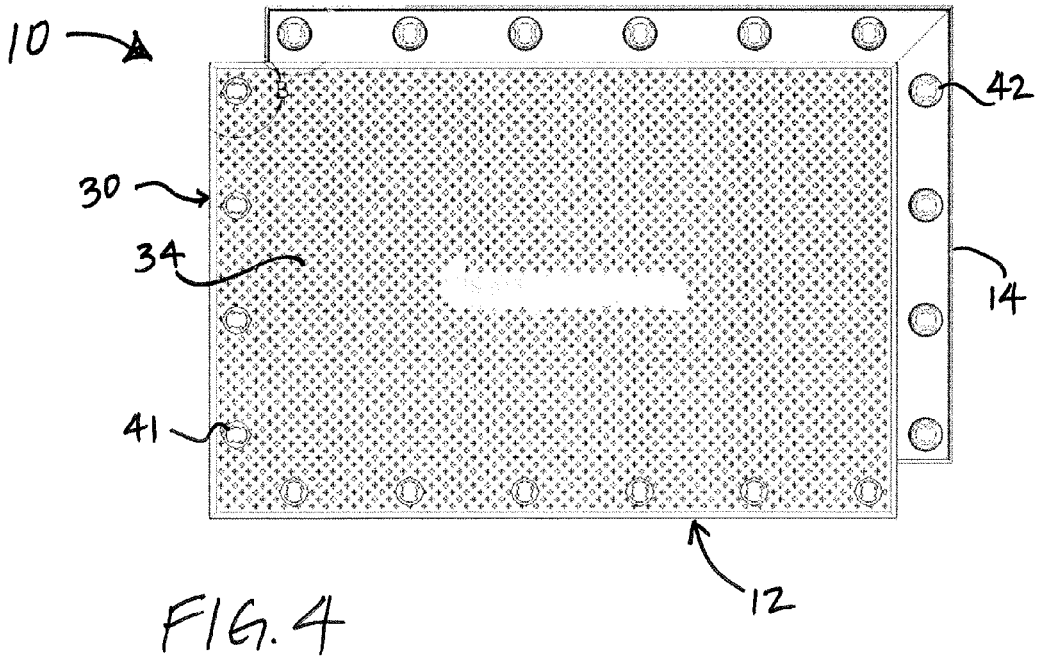
FIG. 4 is a plan view of the opposite side of the modular mat of the present invention.

With reference to FIGS. 1, 3 and 4, the modular mat 10 comprises a central core area 12, and a flange 14 extending outward from the central core area 12. Modular floor mats 10 of the present invention may be constructed of any suitable material that can withstand the intended load for the floor covering. For instance, the mats 10 may be made of a plastic material, such as polypropylene, polyethylene, polystyrene, acrylonitrile butadiene styrene, and polyvinylchloride. In a preferred embodiment, the modular floor mats 10 are constructed of high-density polyethylene (HDPE) post-industrial recycled plastic, optionally reinforced with adhesives for added strength, flex and impact characteristics. This material is resistant to a wide range of temperatures. The material is also extremely strong and able to bear large loads as are common in construction and industrial areas. The material composition of the mats 10 may additionally include impact modifiers for added strength, UV resistant fillers to prevent degradation and delamination and anti-static additives. However, it should be understood that the modular floor mats 10 may be constructed of any suitable material having the strength and durability requirements necessary for their intended purpose. For example, the material is also suitable for providing load bearing for lighter loads as well, such as pedestrian foot traffic in both industrial and non-industrial settings.

Figure 2:
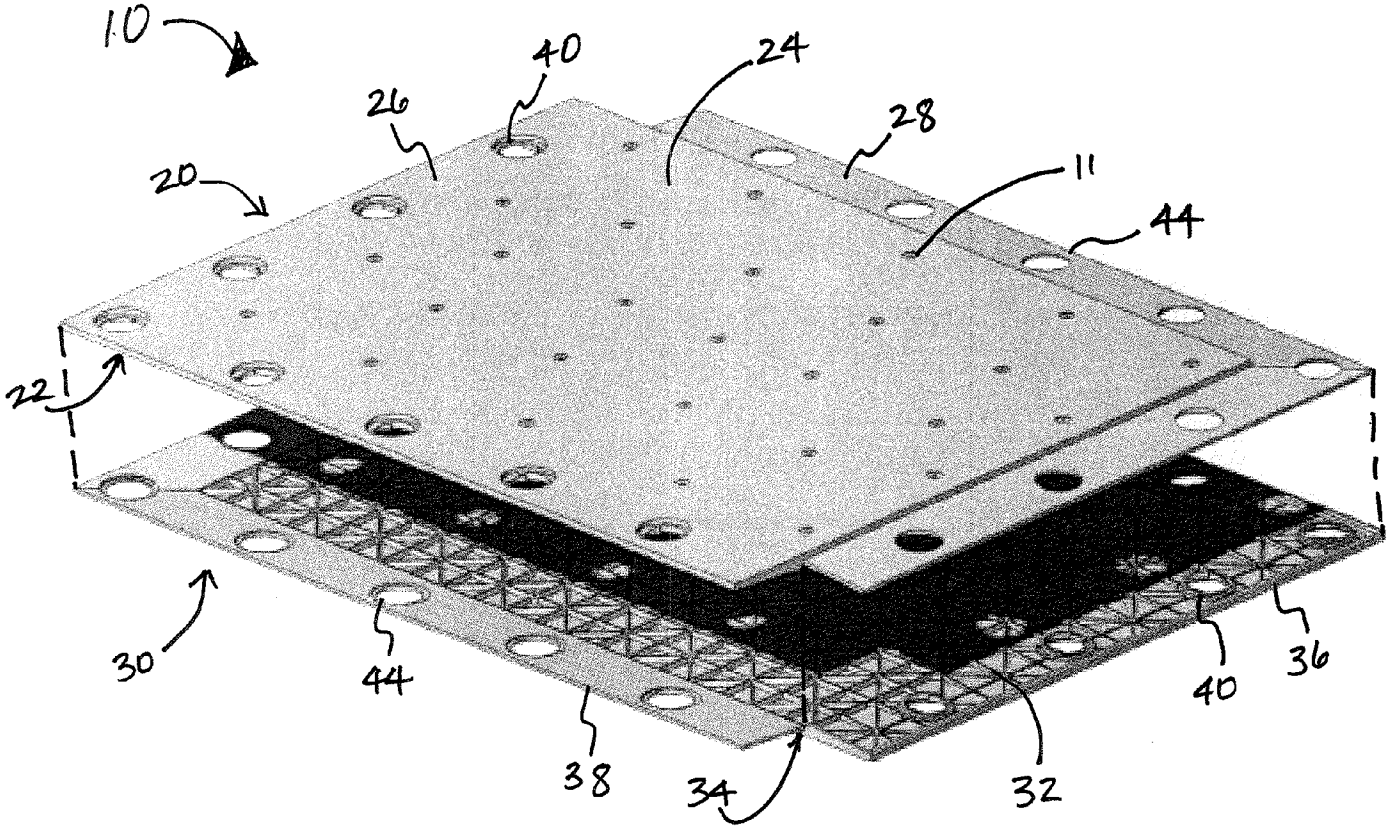
FIG. 2 is an exploded isometric view of the modular mat of FIG. 1.

As best shown in the exploded view of FIG. 2, the mat 10 includes a first layer 20 and a second layer 30. Each of the first and second layers 20, 30 has an inner surface 22, 32 and an outer surface 24, 34, respectively. FIG. 2 shows the outer surface 24 of the first layer and the inner surface 32 of the second layer 30. FIG. 3 shows an embodiment the mat 10 from the outer surface 24 of a first layer 20. FIG. 4 shows the mat 10 from the outer surface 34 of an oppositely disposed second layer 30. Each of these layers 20, 30 may be made of the same material as discussed above, preferably HDPE plastic, optionally reinforced with adhesives or other additives to provide the desired strength and flex characteristics. Each of the layers 20, 30 may be formed by molding, such as compression molding or injection molding, or an otherwise appropriate technique for forming given the particular material used.

With reference to FIGS. 1, 3 and 4, the modular mat 10 comprises a central core area 12, and a flange 14 extending outward from the central core area 12. The central core area 12 comprises the majority of the mat 10 and provides the usable surface of the mat 10, upon which equipment and personnel may travel. As such, the central core area 12 is the primary load bearing portion of the mat 10. It may therefore be substantially planar, to facilitate the bearing of load and conveyance of people and equipment thereon. The central core area 12 shown in FIG. 1 is generally rectangular in shape, however, it may be of any suitable shape, including square or hexagonal, provided that the mats 10 are adapted for overlapping and/or interlocking with adjacent mats 10.

A flange 14 is formed integrally with, and extends outward, from the central core area 12. In a preferred embodiment, the flange 14 and central core area 12 are formed of the same material, such as described above for the mats 10, such as, but not limited to, a high-density polyethylene (HDPE) plastic. The flange 14 is disposed along at least one edge of the mat 10. With reference to FIG. 1, the flange 14 is disposed along two adjacent edges of the mat 10. The flange 14 is configured and positioned to provide an area for an adjacent mat 10 to overlap and join the first mat 10, as will be discussed in greater detail hereinafter. As can be appreciated from FIG. 1, the flange 14 portion of the mat 10 is further structured to taper or reduce in height as it extends away from the central core area 12. In other words, the flange 14 has a sloped incline such that it is thicker where the flange 14 meets the central core area 12 and becomes progressively thinner as the flange 14 extends away from the central core area 12. The flange 14 is thinnest at the outer edge of the flange 14. Such tapering configuration facilitates the overlapping and interconnection of adjacent mats 10 to form a flooring system.

Figure 5A:
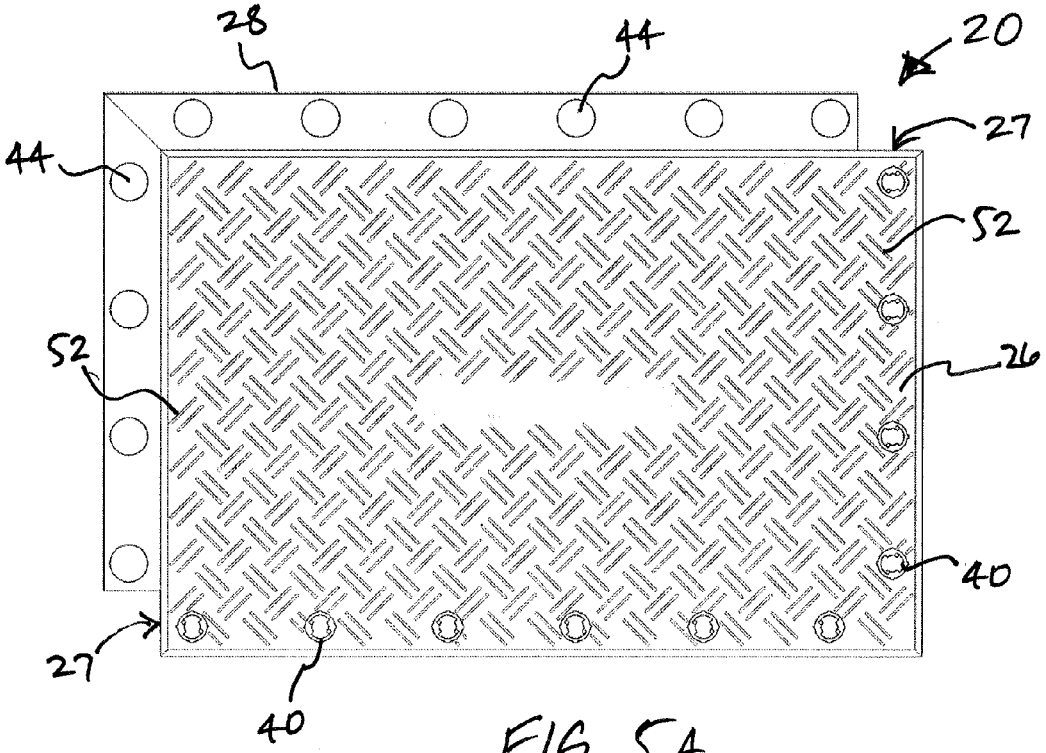
FIG. 5A is a plan view of the outer surface of a first embodiment of the modular mat of the present invention.
Figure 5C:
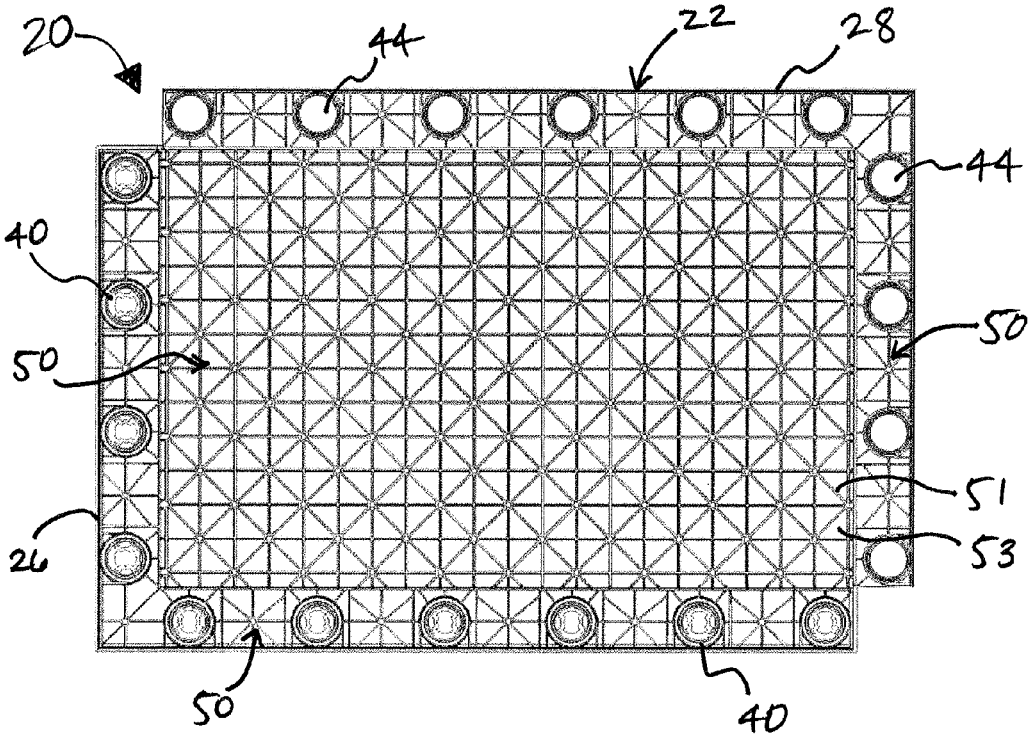
FIG. 5C is a plan view of the inner surface of the embodiment of the modular mat of FIG. 5A.
Figure 6A:
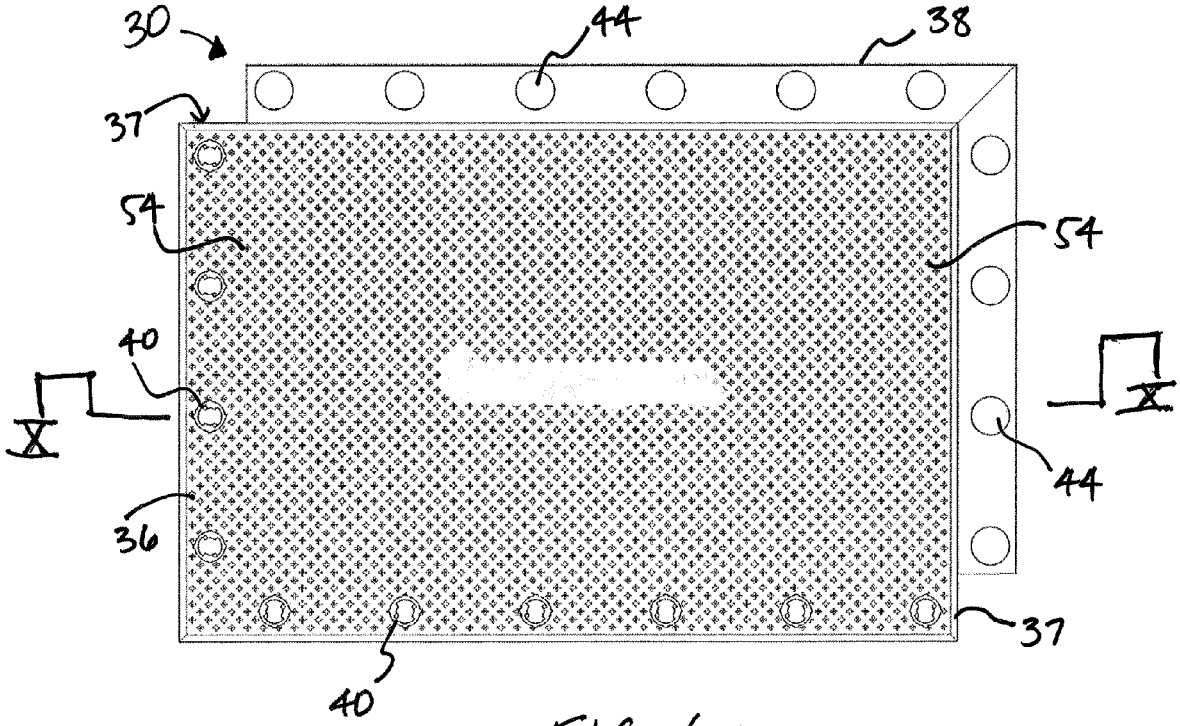
FIG. 6A is a plan view of the outer surface of a second embodiment of the modular mat of the present invention.

Each of the layers comprising the mat 10 accordingly also has a central core area and flange portions. Specifically, as seen in FIGS. 5A and 5C, the first layer 20 includes a central portion 26 and a first flange portion 28. The central portion 26 comprises a majority of the first layer 20, and includes the primary load bearing portion of the first layer 20. In FIG. 5A, the central portion 26 is rectangular, although in other embodiments the central portion 26 may be square, triangular, hexagonal, or other shape as would be suitable for a load bearing portion of a mat 10. The first flange portion 28 is integrally formed with, and extends outwardly from, at least one edge of the central portion 26, but preferably from two adjacent sides. The first flange portion 28 may extend the entire length of a side of the central portion 26, or only a part thereof. In a preferred embodiment, the first flange portion 28 extends along a substantial length of a side of the central portion 26. The second layer 30 similarly has a central portion 36 and second flange portion 38, as seen in FIGS. 6A and 6C.

As can be appreciated from FIGS. 2 and 9A-10B, the first and second layers 20, 30 are joined or affixed together to form the mat 10 of the present invention. The first and second layers 20, 30 are disposed so that their respective inner surfaces 22, 32 are facing one another. Accordingly, the oppositely disposed outer surfaces 24, 34 face outward, as seen in FIGS. 9A-10B. Moreover, the first and second layers 20, 30 are positioned relative to each other so that a peripheral part of the central portion 26 of the first layer 20 corresponds to and matches with the facing second flange portion 38 of the second layer 30, and a peripheral part of the central portion 36 of the second layer 30 corresponds to and matches with the facing first flange portion 28 of the first layer 20, as shown in FIG. 2. The flange 14 of the mat 10 is therefore a combination of a first or second flange portion 28, 38 from one layer and a part of the central portion 26, 36 of the other layer.

Collectively, the first and second layers 20, 30 are arranged and joined to form a single mat 10 of the present invention, which overall has a central core area 12 and flange 14, as seen in FIGS. 1, 3 and 4. The first and second layers 20, 30 are congruently mated and affixed as described above. Accordingly, the mat 10 is defined by a perimeter 16 that encompasses both the central core area 12 and flange 14. The flange 14 is not separate from the mat 10, but rather, is integrally formed within and in part defines the mat 10. As can be seen in FIG. 1, the perimeter 16 of the mat 10 is congruent throughout its entirety, such that there are no overhangs or offset portions of the mat 10 in which any portion of first and second layers 20, 30 are not matched to corresponding sections of the opposite layer 20, 30.

The first and second layers 20, 30 are joined by affixing their inner surfaces 22, 32 together. The inner surfaces 22, 32 may be affixed by any suitable means of securing the two surfaces together, including, but not limited to, the use of connectors such as bolts or screws, adhesive material such as glue, welding such as hand welding or hot welding, and other methods as are appropriate for the materials comprising the inner surfaces 22, 32. Further, multiple methods of affixing the inner surfaces 22, 32 can be utilized simultaneously. For example, the inner surfaces 22, 32 may be both glued and bolted together. In other embodiments, the inner surfaces 22, 32 are both bolted and welded together. In at least one embodiment, some portions of the inner surfaces 22, 32 are bolted together and different portions of the inner surfaces 22, 32 are welded together. For instance, the central portion of inner surfaces 22, 32 may be bolted together, and the perimeter of the formed mat 10 may be hand welded along the interface of the joined inner surfaces 22, 32 to create a seal around the mat 10.

In at least the embodiment of FIGS. 1 and 2, the inner surfaces 22, 32 are affixed together with a plurality of bolts (not shown) disposed through fixation holes 11 extending through the mat 10. The central portion 26, 36 of each layer include a plurality of fixation holes 11 disposed there through. The fixation holes 11 in the central portion 26 of the first layer 20 correspond to fixation holes 11 in the central portion 36 of the second layer 30 when the two layers are paired together. The fixation holes 11 are configured to receive a connector, such as a bolt or screw, to join the two layers 20, 30 together. In at least one embodiment, the fixation holes 11 are configured to receive bolts, which may be sex bolts comprised of a male and female half, in which each half of the bolt enters from an opposite layer 20, 30 of the mat 10 to secure the layers together.

In a preferred embodiment, such as those of FIGS. 3 and 4, the inner surfaces 22, 32 are welded together along at least a portion of the inner surfaces 22, 32, and most preferably along the entire inner surfaces 22, 32. Such welding may include hot welding, wherein at least one, but preferably each of the inner surfaces 22, 32 are heated to a temperature sufficient to soften (but not melt) the material comprising the inner surfaces 22, 32. The heated, softened inner surfaces 22, 32 are then joined and compressed together, and allowed to cool under compression. Any material extruded at the seam of the joined inner surfaces 22, 32 resulting from compression may be removed, such as by grinding, milling or routing once the surfaces are cooled.

As indicated in FIGS. 2, 5C and 6C, the inner surfaces 22, 32 of the first and second layers 20, 30 may include reinforcing structure 50 integrally formed therein for structural support. For instance, FIGS. 5C and 5D show the inner surface 22 of the first layer 20. At least a portion of this inner surface 22 includes a reinforcing structure 50. The reinforcing structure 50 comprises a series of intersecting reinforcing ribs 51, creating spaces 52 within the inner surfaces 22, 32 of the layers 20, 30. The reinforcing ribs 51 may be disposed in any suitable configuration, such as square, rectangle, triangular, honeycomb and circular patterns, including combinations thereof. The reinforcing ribs 51 are fully integrated into the first layer 20. For instance, the reinforcing ribs 51 may be constructed or molded from the same material as the first layer 20, as discussed above. The reinforcing ribs 51 extend substantially the full thickness of the first layer 20, such that the reinforcing structure 50 has the same height dimension throughout the first layer 20, as seen in the cross-section of the mat 10 in FIG. 10A. Weight from a load imparted on the outer surface 24 is propagated through the mat 10 by way of the reinforcing ribs 51, which run perpendicular to the outer surface 24. The reinforcing ribs 51 therefore provide strength to the mat 10, as well as weight distribution to prevent uneven wear of the mat 10. The spaces 52 defined between the reinforcing ribs 51 reduce the amount of material needed for the mat 10. Accordingly, the reinforcing structure 50 provides strength and durability to the mat 10 while minimizing the material needed, thus enabling the mat 10 to be easily portable. Preferably, as seen in FIG. 5C, the reinforcing structure 50 covers the entire inner surface 22, including the central portion 26 and the first flange portion 28 of the first layer. In some embodiments, however, the reinforcing structure 50 may only cover the central portion 26, the first flange portion 28, or parts thereof.

Figure 6B:
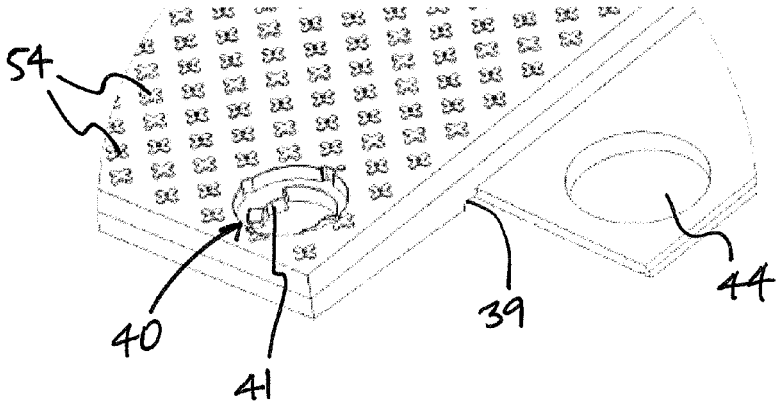
FIG. 6B is an isometric view of detail of the outer surface of the embodiment of the modular mat of FIG. 6A.
Figure 6C:
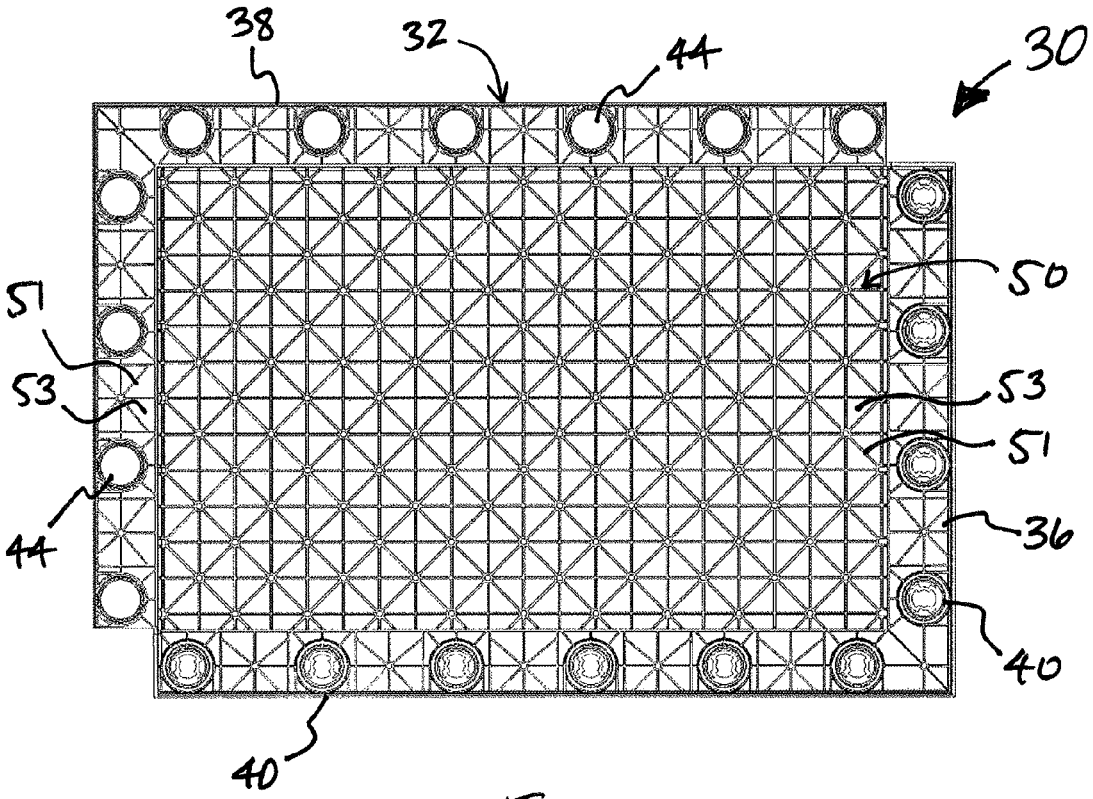
FIG. 6C is a plan view of the inner surface of the embodiment of the modular mat of FIG. 6A.
Figure 6D:
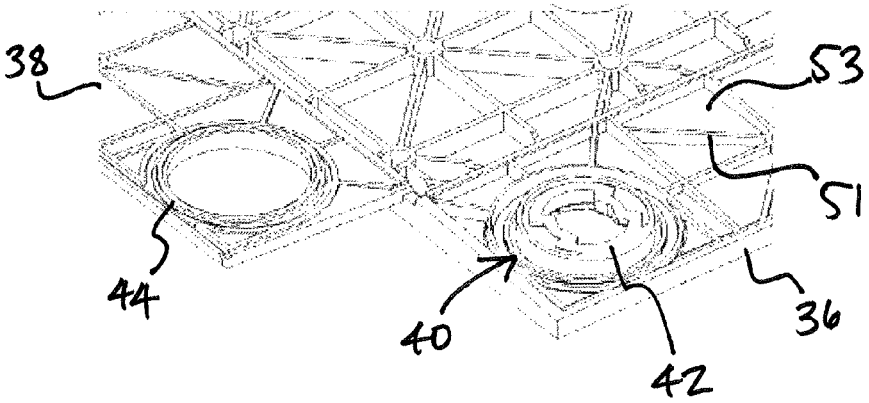
FIG. 6D is an isometric view of detail of the inner surface of the embodiment of the modular mat of FIG. 6C.
Figure 10A:
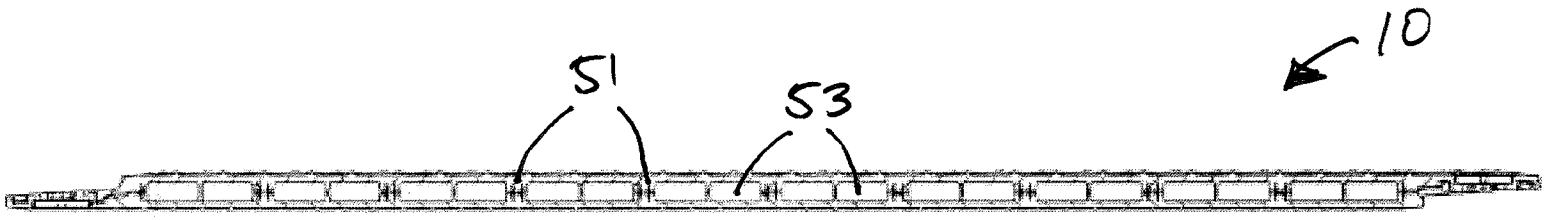
FIG. 10A is a cross-sectional elevation of the modular mat of FIG. 6A.

FIGS. 6C and 6D show the inner surface 32 of the second layer 30. At least a portion of this inner surface 32 includes a reinforcing structure 50 comprising intersecting reinforcing ribs 51 and spaces 52 defined therein. The reinforcing structure 50 of the inner surface 32 of the second layer 30 is substantially the same as that described above for the inner surface 22 of the first layer 20. When the layers 20, 30 are joined and affixed together, the reinforcing structure 50 of the first layer 20 corresponds to and matches the reinforcing structure 50 of the second layer 30, as seen in FIG. 10A. Therefore, the interior of the mat 10 is consistent throughout.

The outer surfaces 24, 34 of the first and second layers 20, 30 are disposed for contacting and engaging the transportation elements, such as walking or vehicular traffic, which may further include heavy loads of equipment, materials, or may simply involve a high degree of traffic. Accordingly, the outer surfaces 24, 34 include a plurality of traction elements 52, 54 to increase the friction on the surface and permit the vehicle and/or pedestrian greater purchase on the surface. The traction elements 52, 54 therefore increase the safety of the mat 10. The traction elements 52, 54 generally extend outward from the outer surface 24, 34 of the mat 10 sufficiently to provide additional friction to the surface, but not so far as to be an impediment to motion across the surface. The traction elements 52, 54 may also be recesses in the outer surfaces 24, 34 of the mat 10, or a combination of extensions and recesses. They may be disposed in any orientation and configuration along the outer surface 24, 34.

In a preferred embodiment, the mat 10 includes different grades of traction elements 52, 54 for creating different amounts or types of friction, which may be particularly suited for a specific kind of traffic. As can be seen at least in FIGS. 5A-6D, the traction elements 52, 54 are disposed on the central core area 12 of the mat 10, and specifically on the central portion 26, 36 of the composite layers of the mat 10, as these are the load-bearing portions of the mat 10. These different grades of traction elements 52, 54 may be located on the same surface of the mat 10, although in a preferred embodiment, each layer of the mat 10 comprises one kind of traction element, and the traction elements of the first layer 20 may be of a different kind than those on the second layer 30.

Figure 5B:
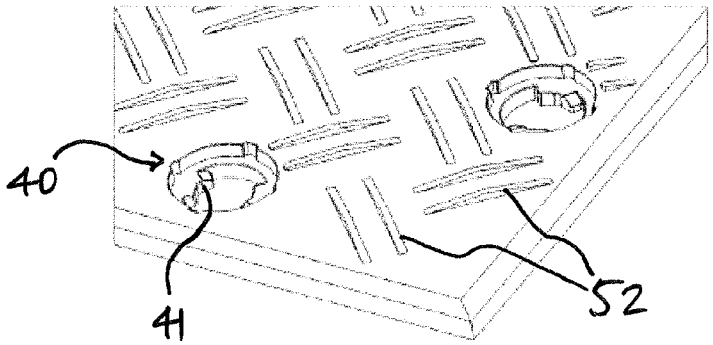
FIG. 5B is an isometric view of detail of the outer surface of the embodiment of the modular mat of FIG. 5A.
Figure 5D:
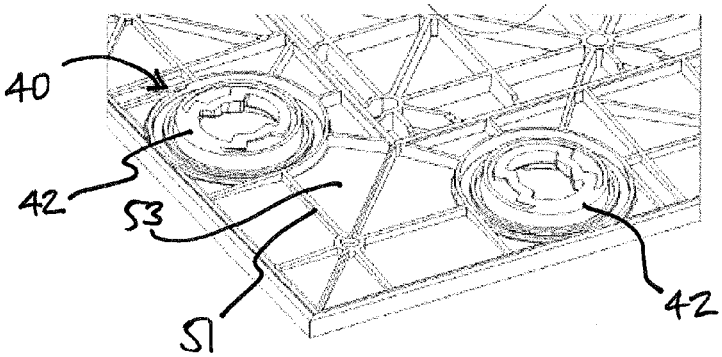
FIG. 5D is an isometric view of detail of the inner surface of the embodiment of the modular mat of FIG. 5C.

For instance, as depicted in FIGS. 5A and 5B, the first layer 20 includes a plurality of industrial grade traction elements 52. These industrial grade traction elements 52 are raised portions of the outer surface 24, and are of a size and shape appropriate to support the heavy weight loads of industrial applications, such as construction vehicles and equipment, as well as engage large tires or other traction elements during inclement weather or submersion in water or mud. The number and distribution of the industrial grade traction elements 52 may vary according to a particular contemplated weight load. Generally, the heavier the weight intended to be supported on the first layer 20, the larger in size and dimension and/or number of the industrial grade traction elements 52 present on the outer surface 24.

Referring to FIGS. 6A and 6B, the second surface 30 includes a plurality of pedestrian grade traction elements 54. These pedestrian grade traction elements 54 are preferably raised portions of the outer surface 34, and are of a size, shape and configuration to support people walking, running, dancing, or otherwise moving or standing on the outer surface 34 of the mat 10. However, it is contemplated that the pedestrian grade traction elements 54 may include raised portions or recesses in the outer surface 34. The pedestrian grade traction elements 54 are preferably raised areas of the outer surface 34, but generally do not comprise as high of an elevation as the industrial grade traction elements 52 on the opposing side of the mat 10. Moreover, as is apparent from FIG. 6B, the pedestrian grade traction elements 54 may include a substantially planar top surface to facilitate easier walking or standing by people, as compared to the industrial grade traction elements 52 of FIG. 5B, which need not necessarily have a planar top surface.

Figure 10B:
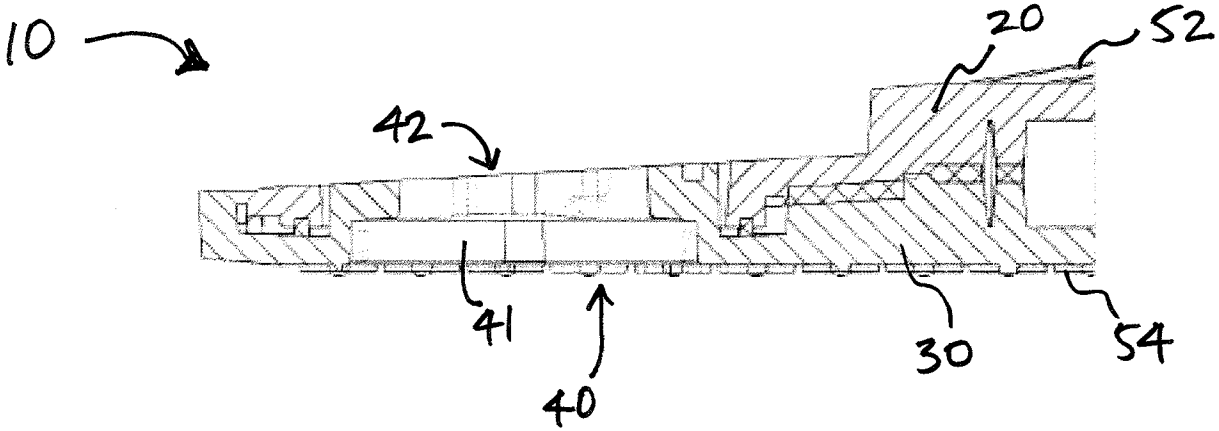
FIG. 10B is a detail of the side elevation of the modular mat of FIG. 10A.

As shown in FIGS. 5A-6D, each of the first and second layers 20, 30 further include at least one fitting receiver 40 integrally formed therein. The fitting receiver 40 extends through the entire layer first or second layer 20, 30, as shown in FIG. 10B, and defines a space in its center. Preferably, the first and second layers 20, 30 include a plurality of fitting receivers 40. Each fitting receiver 40 is configured to matingly engage and receive a corresponding pin for attachment purposes, as described in greater detail hereinafter. In at least one embodiment, as shown throughout the Figures, the fitting receiver 40 is shaped as receptacle of a cam lock, which is structured to receive and matingly restrain a cam locking pin. It should be appreciated, however, that the receiver 40 may be of any configuration or shape as is appropriate for securing purposes.

The fitting receivers 40 preferably are formed along and extend through an attachment edge 27, 37 of each layer 20, 30. The attachment edges 27, 37 are sides of the central portions 26, 36 that do not have a flange portion 28, 38 extending therefrom. For example, as seen in the embodiments of FIGS. 5A and 6A, the attachment edges 27, 37 comprise the sides of the central portion 26, 36 opposite the flange portions 28, 38. Accordingly, the central core area 12 of the mat 10 includes an attachment edge 18 disposed along at least one edge of the mat 10. With particular reference to FIG. 1, the central core area 12 includes two attachment edges 18 disposed along adjacent edges of the central core area 12. These attachment edges 18 are disposed on different sides of the central core area 12 from the flange 14. Preferably, the attachment edges 18 are disposed opposite from the flange 14. These attachment edges 18 are structured to overlap the flange 14 of another, adjacent mat 10 when forming the flooring system, as will be discussed in greater detail hereinafter. In at least one embodiment, as illustrated in FIG. 6B, at least one of the attachment edges 27, 37 have a sloped incline which is dimensioned to receive a corresponding flange portion 28, 38 of the opposing layer 20, 30. This incline may include a notch 39 or other structure configured to facilitate the fitting of the flange portion 28, 38 of one layer into the sloped incline area of the corresponding attachment edge 27, 37 of the opposing layer. This produces a slope in the resulting flange 14 of the mat 10, to enable overlapping joining of adjacent mats 10.

Figure 7B:
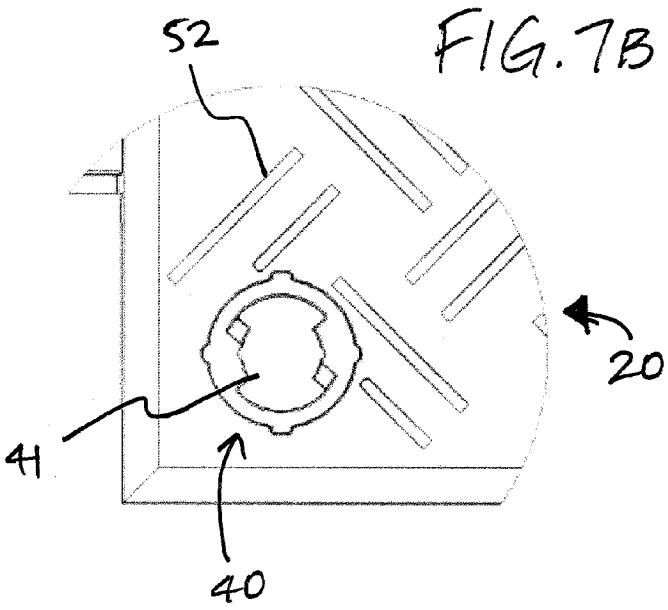
FIGS. 7A and 7B are plan views of the receiving end of the fitting receivers.
Figure 7A:
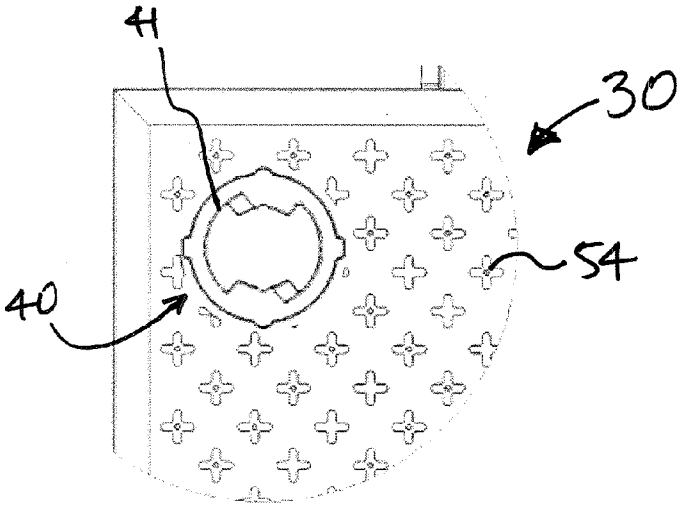
Figure 8B:
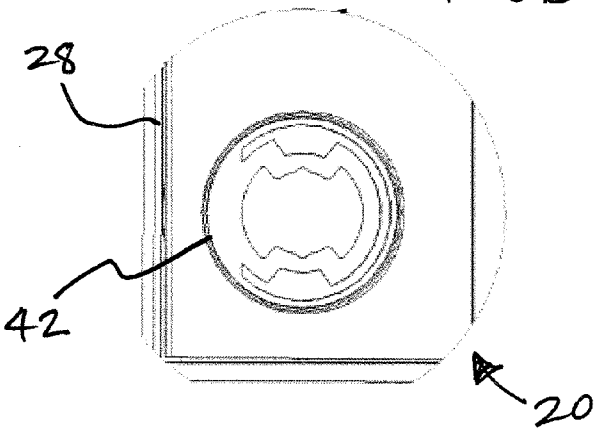
FIGS. 8A and 8B are plan views of the locking end of the fitting receivers.
Figure 8A:
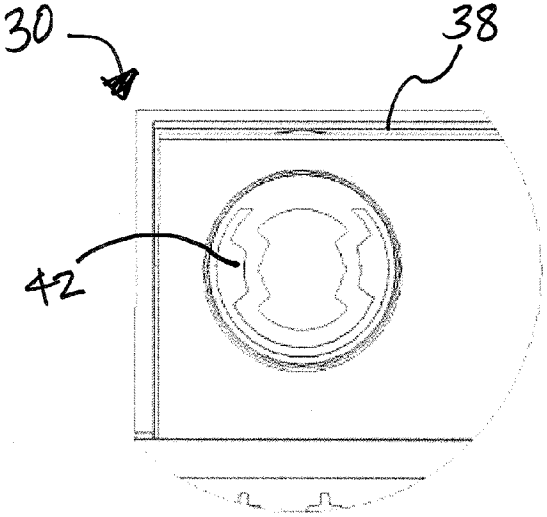
Figure 9A:
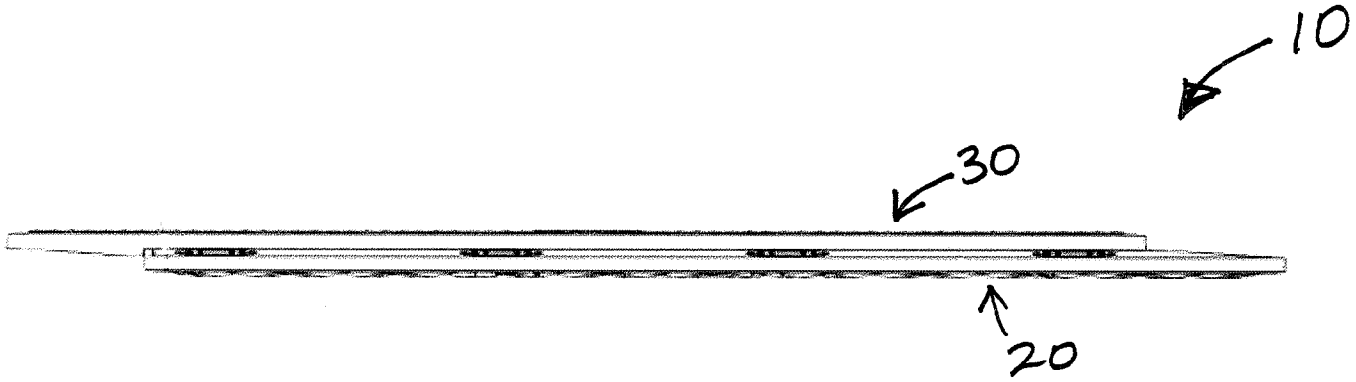
FIG. 9A is a side elevation of the modular mat of the present invention.
Figure 9B:
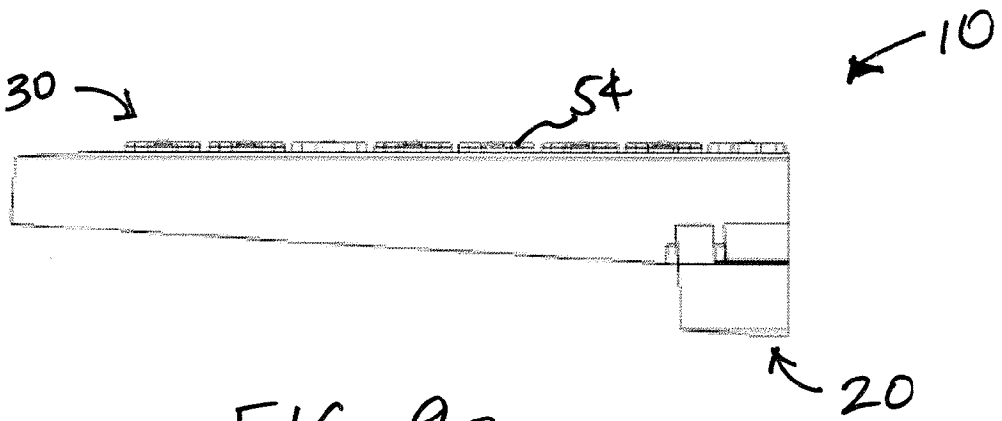
FIG. 9B is a detail of the side elevation of the modular mat of FIG. 9A taken along line X-X.

Returning to FIGS. 5-6, and with specific reference to FIGS. 5B and 5D, the fitting receivers 40 have a receiving end 41 at one end and a locking end 42 at the opposite end. The receiving end 40 is structured to receive the corresponding mating locking pin (not shown) for engagement. Accordingly, the receiving end 40 is integrally formed in the outer surface 24 of the first layer 20, as in FIG. 5B, and the opposite locking end 42 is formed at the inner surface 22 of the first layer, as in FIG. 5D. Similarly, the fitting receivers 40 in the second layer 30 are formed such that the receiving ends 42 are formed in the outer surface 34 of the second layer, as in FIG. 6B, and the opposing locking ends 42 are formed at the inner surface 32 of the second layer, as in FIG. 6D. Details of the receiving ends 41 of fitting receivers 40 are shown at FIGS. 7A and 7B, on respective layers 20, 30 of the mat. Details of the locking ends 42 of the fitting receivers 40 are shown in FIGS. 8A and 8B of respective layers 20, 30 of the mat 10.

The first and second layers 20, 30 also include at least one, but preferably a plurality of apertures 44 extending through the first and second flange portions 28, 38, respectively. For instance, as seen in FIGS. 5A and 5C, the first flange portion 28 of the first layer 20 includes a plurality of apertures 44. These apertures 44 are dimensioned to permit a corresponding fitting receiver 40, and specifically the locking end 42 of a fitting receiver 40, from an opposite layer there through. Similarly, the second flange portion 38 of the second layer 30 also includes a plurality of such apertures 44, as depicted in FIGS. 6A-6D.

Accordingly, when the first and second layers 20, 30 are brought together to form the mat 10 of the present invention, the fitting receivers 40 of the central portion 26, 36 of one layer line up with corresponding apertures 44 of the flange portions 28, 38 of the opposing layer, as illustrated in FIG. 2. The fitting receivers 40 pass through the corresponding apertures 44, so that when the layers 20, 30 are affixed together in the final configuration, the mat 10 comprises a plurality of fitting receivers 40 disposed through the attachment edges 18 and the flanges 14, as best seen in FIGS. 3 and 4. The receiving ends 41 of the fitting receivers 40 are present at the core central area 12 of the mat 10, and the locking ends 42 are present along the flange 14 of the mat.

The present invention also contemplates a floor covering system 100 composed of a contiguous placement of the above-described mats 10. Therefore, there are no significant gaps between the modular floor mats 10 to provide essentially complete coverage of the subsurface being covered.

Figure 11:
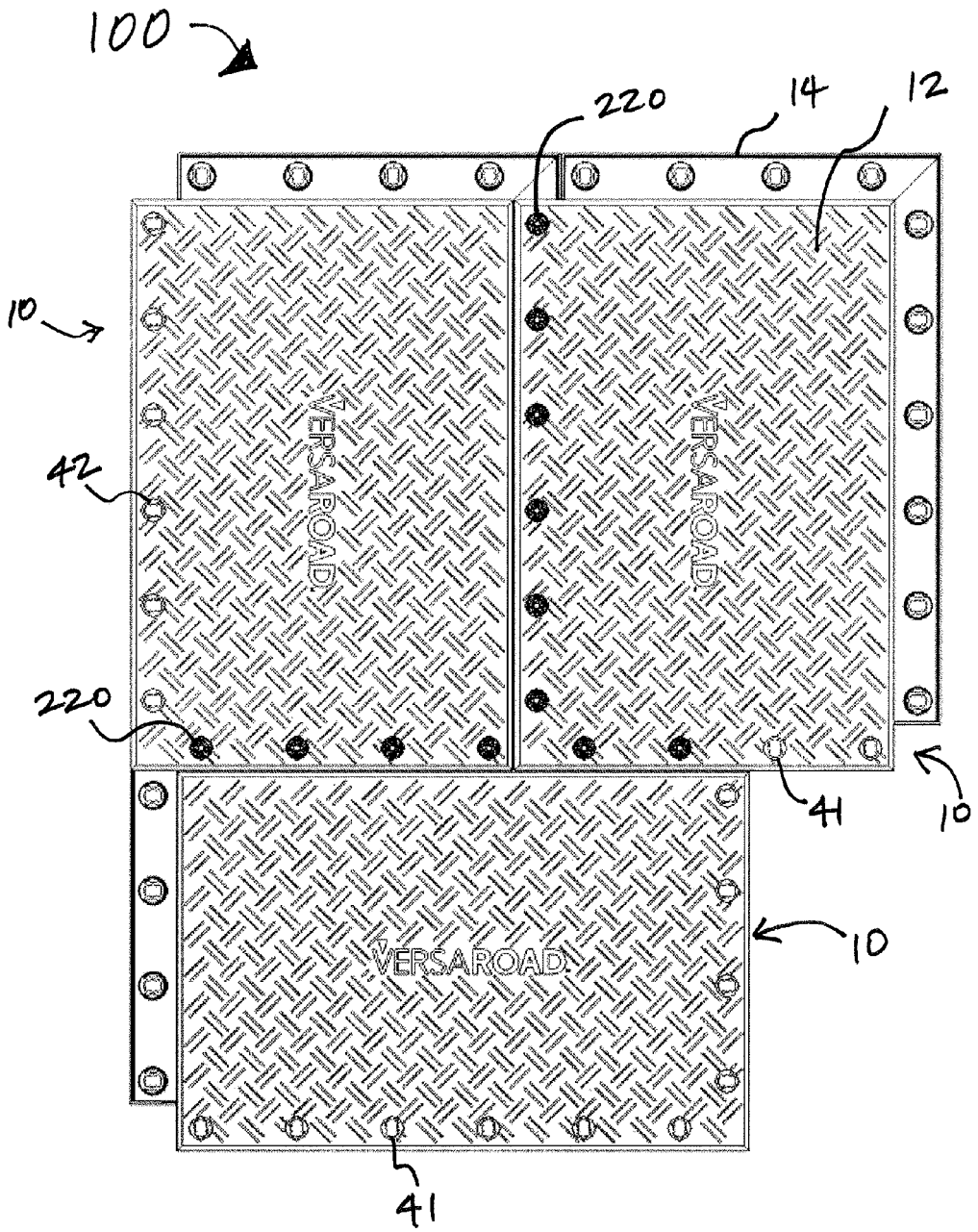
FIG. 11 is a top plan view of the floor covering system of the present invention.

As shown in FIG. 11, the floor covering system 100 of the present invention includes a plurality of mats 10 disposed in adjoining, overlapping and interlocking fashion. The system 100 is extendable in multiple directions to accommodate a desired topographic plan. Such topographic plan is typically directed towards the conveyance or support of equipment, vehicles, personnel and the like and is adapted to conform to the topographic or geographic features of the substrate surface, such as grass, dirt, artificial turf or the like. When connected in a floor covering system 100, the mats 10 of the present invention provide distribution of weight over a larger surface area, thus allowing heavy equipment to traverse varying ground conditions.

Figure 12:
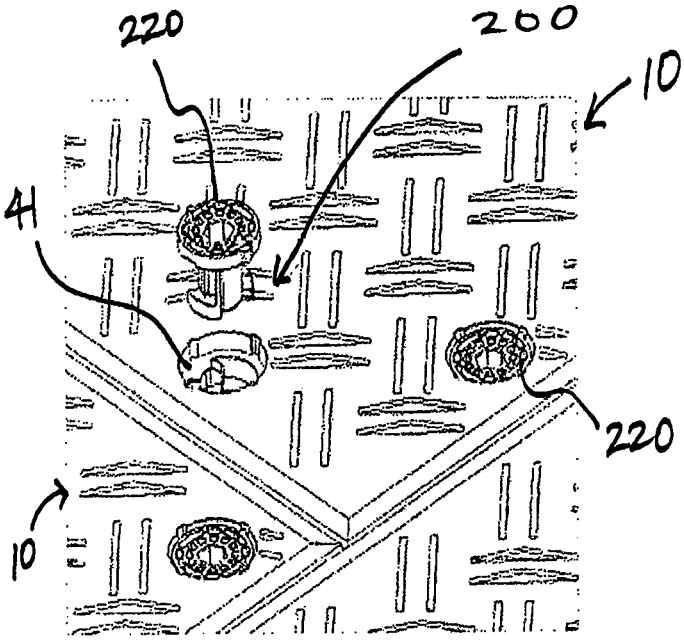
FIG. 12 is a detail view of the system of FIG. 11.
Figure 15:
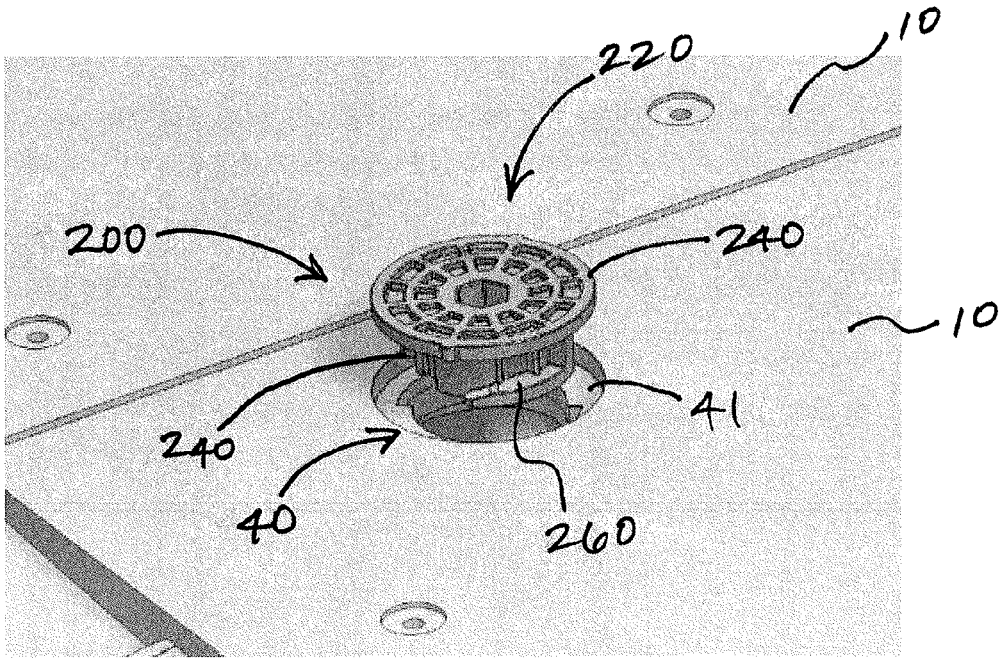
FIG. 15 is an isometric view of the connecting assembly of the present invention.

The floor covering system 100 further comprises a connection assembly 200, as shown in FIGS. 12 and 15. The connection assembly 200 includes a fitting receiver 40 integrally formed in a mat 10 and a corresponding locking pin 220 which inserts into and is retained within the fitting receiver 40.

The floor covering system 100 is built by securing one modular mat 10 to an adjacent modular mat 10, as in FIG. 11. Adjacent mats 10 are disposed in at least partially overlapping fashion, such that the attachment edge 18 of one mat 10 overlaps a flange 14 of an adjacent mat. The fitting receivers 40 integrally formed in the mats 10 also overlap and correspond one to another, such that the fitting receivers 40 of one mat 10 align with the fitting receivers 40 of the adjacent, underlying mat 10. As shown in FIGS. 12 and 15, a locking pin 220 is then placed into a receiving end 41 of a fitting receiver 40. The locking pin may be a cam locking pin, as shown in the Figures, although it should be appreciated that other locking pins 220 having different configurations may be used as corresponds to and matingly fits within the particular fitting receiver 40 integrally formed in the mats 10. The locking pin 220 may be constructed of plastic, such as the same HDPE plastic used in forming the mat 10. In other embodiments, the locking pin 220 may be made of high grade metal, such as aluminum, or other material that is suitable for engaging material of the mat 10.

Since each fitting receiver 40 engages a different pin 220, the system 100 may include a plurality of connection assemblies 200. In a preferred embodiment, a plurality of fitting receivers 40 are formed along the edges of the mat 10, and accommodate a plurality of corresponding locking pins 220, thereby providing a number of securing points along the mats 10. This provides stability to the floor covering system 100, restricting the movement of individual mats 10 as a load is moved across multiple mats 10.

Figure 13B:
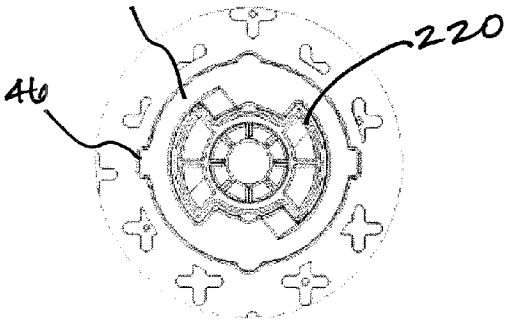
FIGS. 13A and 13B are plan views of the connecting assembly in the unlocked position.
Figure 13A:
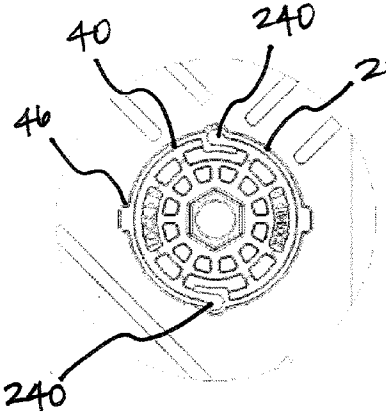
Figure 13C:
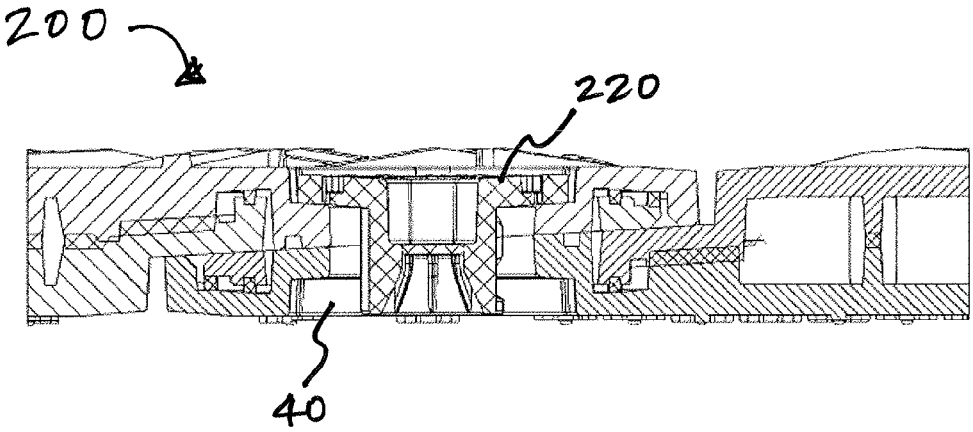
FIG. 13C is a cross-sectional elevation of the connecting assembly in the unlocked position.

Each of the locking pins 220 includes at least one restraint mechanism, which may include at least one protrusion 240 extending radially from a surface of the locking pin 220. The protrusion(s) 240 is configured to securely engage a portion of the fitting receiver 40 in order to lock one overlapping mat 10 to another. For instance, as shown in FIG. 13A, the locking pin 220 is configured to fit within a receiving end 41 of a fitting receiver 40. In this unlocked position, a number of protrusions 240 on the sides of the locking pin 220 easily fit into corresponding spaces configured in the fitting receiver 40. FIG. 13B shows the fitting receiver 40 and locking pin 220 in the unlocked position from the opposite side of the mat 10. FIG. 13C shows a cross-sectional elevation of the fitting receiver 40 and locking pin 220 in an unlocked position.

Figure 14B:
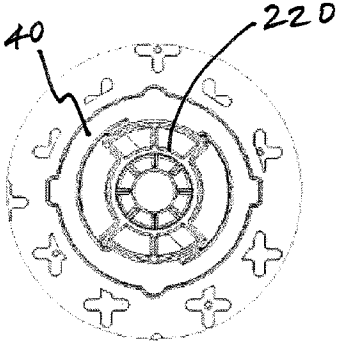
FIGS. 14A and 14B are plan views of the connecting assembly in the locked position.
Figure 14A:
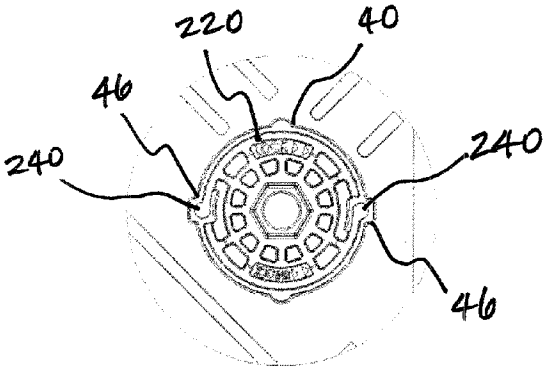
Figure 14C:
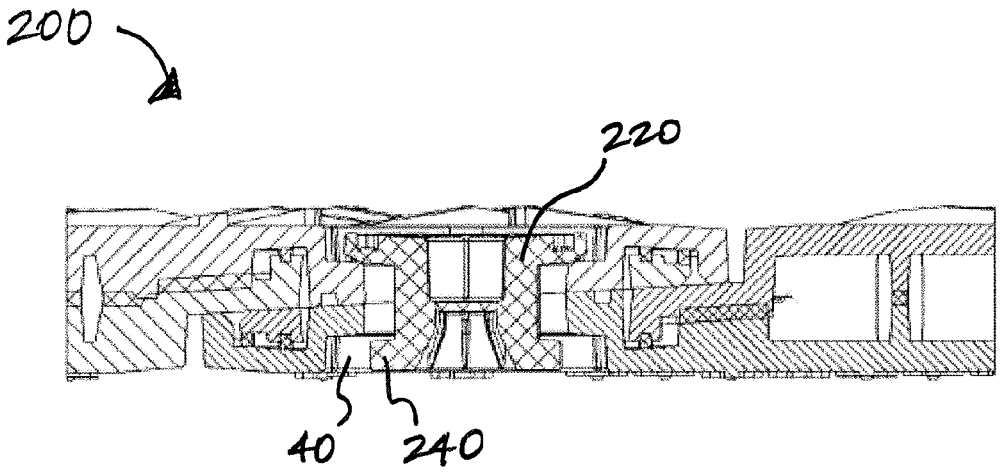
FIG. 14C is a cross-sectional elevation of the connecting assembly in the locked position.

The locking pin 220 may be rotated or turned, such as by using a key or tool (not shown), to move the locking pin 220 into a locked position, which is shown in FIG. 14A. In this locked position, the protrusions 240 now engage restricting structures 46 within the fitting receiver 40 that are configured to restrain further movement of the protrusions 240, thereby locking the pin 220 in place. FIG. 14B shows the fitting receiver 40 and locking pin 220 in the locked position from the opposite side of the mat 10. FIG. 14C shows a cross-sectional elevation of the fitting receiver 40 and locking pin 220 in the locked position.

In a preferred embodiment, the locking pin 220 includes a plurality of protrusions 240, at least one of which is a ramp 260 configured to engage a corresponding interior portion of a fitting receiver 40 so as to produce compressive force as the locking pin 220 is turned from an unlocked to a locked position. As shown in FIG. 15, the ramp 260 is formed in the exterior of the locking pin 220 and slopes at an incline radially outward from the locking pin 220. The interior of the fitting receiver 40 may have a corresponding slope configured to matingly receive the ramp. As the locking pin 220 is turned within the fitting receiver 40, the ramp 260 engages the corresponding structure of the fitting receiver 40 of the lower, underlying mat 10. Accordingly, as the locking pin 220 turns, the ramp 260 effectively pulls the mats 10 together and compressively secures them tightly together. As a result, the mats 10, once locked, do not move relative to one another.

Figure 16:
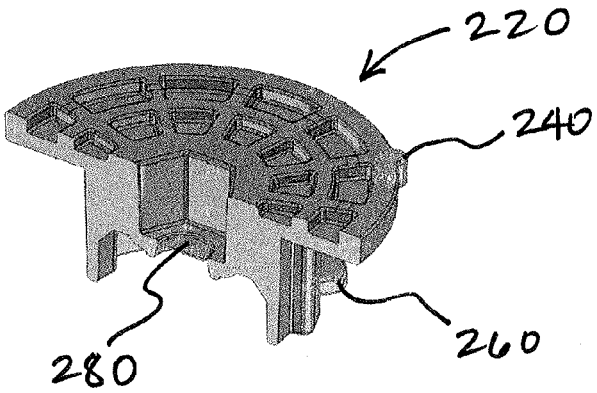
FIG. 16 is a cross-sectional cut-away of the pin of the connecting assembly.

In at least one embodiment, the locking pin 220 also comprises a removable blocking wall 280, as shown in FIG. 16. The blocking wall 280 is disposed across the inner diameter of the locking pin 220 to prevent the passage of material through the pin 220. Accordingly, debris from the surface of the floor covering system 100 does not enter the locking mechanism, and therefore does not interfere with the interlocking of the mats 10. The blocking wall 280 may preferably be recessed from the exterior surface of the pin 220, so that it does not prevent actuation of the pin 220 by a tool or key for locking and unlocking. Additionally, the blocking wall 280 may be removable, such as by puncturing, if desired to permit material such as rainwater to pass through the floor covering system 100.

Since many modifications, variations and changes in detail can be made to the described preferred embodiments, it is intended that all matters in the foregoing description and shown in the accompanying drawings be interpreted as illustrative and not in a limiting sense. Thus, the scope of the invention should be determined by the appended claims and their legal equivalents. Now that the invention has been described,

What is claimed is:

1. A modular mat for forming a floor covering, comprising:

a first layer comprising a central portion and a first flange portion extending outwardly from said central portion, said first flange portion disposed along adjacent sides of said first layer;

a second layer comprising a central portion and a second flange portion extending outwardly from said central portion, said second flange portion disposed along adjacent sides of said second layer;

at least one fitting receiver integrally formed and extending through said central portion of said first layer and said second layer, wherein said at least one fitting receiver is structured for restricting engagement of a locking pin;

at least one aperture formed in and extending through said first flange portion and said second flange portion;

wherein said first layer and said second layer are mirror images;

said first layer affixed to said second layer such that said first flange portion and said second flange portion are congruently mated and form a congruent flange extending substantially along said modular mat;

wherein said first layer and said second layer are affixed such that said at least one fitting receiver of said first layer is aligned with said at least one aperture of said second layer.

2. The mat as recited in claim 1, wherein said at least one fitting receiver comprises a receiving end structured to receive a locking pin and an oppositely disposed locking end structured for restricting engagement of at least a portion of a locking pin therein.

3. The mat as recited in claim 2, wherein said receiving end is disposed at an outer surface of said first layer and said second layer, and wherein said locking end is disposed at an inner surface of said first layer and said second layer.

4. The mat as recited in claim 1, wherein said fitting receiver comprises at least one restricting structure configured to restrain movement of a portion of a locking pin when disposed therein.

5. The mat as recited in claim 1, further comprising at least one attachment edge defined along a side of said core area, wherein said at least one attachment edge comprises a sloped incline dimensioned to receive said first flange portion or said second flange portion of said corresponding oppositely disposed second layer or first layer.

6. The mat as recited in claim 5, wherein the sloped incline of said at least one attachment edge is disposed along said inner surface of said first layer and said second layer.

7. The mat as recited in claim 6, said sloped incline further comprising a notch dimensioned to receive a corresponding notch in an opposing said first layer or said second layer for fitting engagement of said first layer and said second layer.

8. The mat as recited in claim 1, wherein said first layer and said second layer each comprise an inner surface and an oppositely disposed outer surface, and wherein said first layer and said second layer are affixed at said inner surfaces.

9. The mat as recited in claim 8, wherein said inner surfaces of said first layer and said second layer comprise a reinforcing structure integrally formed in and extending substantially the full thickness of said first layer or said second layer.

10. The mat as recited in claim 9, wherein said reinforcing structure comprises at least one reinforcing rib integrally formed in and extending substantially the full thickness of said first layer or said second layer.

11. The mat as recited in claim 10, further comprising a plurality of reinforcing ribs disposed in a strengthening configuration.

12. The mat as recited in claim 11, wherein said reinforcing structure further comprises at least one space defined between at least two of said plurality of reinforcing ribs.

13. The mat as recited in claim 10, wherein said plurality of reinforcing ribs are disposed in intersecting relation to one another.

14. The mat as recited in claim 9, wherein said reinforcing structure of said first layer matingly corresponds with said reinforcing structure of said second layer.

15. The mat as recited in claim 8, wherein said outer surfaces of said first layer and said second layer comprise a plurality of traction elements.

16. The mat as recited in claim 15, wherein said outer surfaces of said first layer and said second layer comprise different grades of traction elements.

17. The mat as recited in claim 16, wherein said first layer comprises industrial grade traction elements.

18. The mat as recited in claim 16, wherein said first layer comprises pedestrian grade traction elements.

19. A method of forming the modular mat as recited in claim 8, comprising hot welding said inner surface of said first layer to said inner surface of said second layer.

20. A method of forming the modular mat as recited in claim 1, comprising hot welding the first layer and second layer together.

21. A modular mat for forming a floor covering, comprising:

a first layer comprising a central portion and a first flange portion extending outwardly from said central portion, said first flange portion disposed along adjacent sides of said first layer;

a second layer comprising a central portion and a second flange portion extending outwardly from said central portion, said second flange portion disposed along adjacent sides of said second layer;

at least one fitting receiver integrally formed and extending through said central portion of said first layer and said second layer, wherein said at least one fitting receiver is structured for restricting engagement of a locking pin;

at least one aperture formed in and extending through said first flange portion and said second flange portion;

wherein said first layer and said second layer are mirror images;

said first layer affixed to said second layer such that said first flange portion and said second flange portion are congruently mated and form a congruent flange extending substantially along said modular mat;

further comprising at least one attachment edge defined along a side of said core area, wherein said at least one attachment edge comprises a sloped incline dimensioned to receive said first flange portion or said second flange portion of said corresponding oppositely disposed second layer or first layer.

22. The mat as recited in claim 21, wherein said first layer and said second layer are affixed such that said at least one fitting receiver of said first layer is aligned with said at least one aperture of said second layer.

23. The mat as recited in claim 21, wherein said at least one fitting receiver comprises a receiving end structured to receive a locking pin and an oppositely disposed locking end structured for restricting engagement of at least a portion of a locking pin therein.

24. The mat as recited in claim 23, wherein said receiving end is disposed at an outer surface of said first layer and said second layer, and wherein said locking end is disposed at an inner surface of said first layer and said second layer.

25. The mat as recited in claim 21, wherein said fitting receiver comprises at least one restricting structure configured to restrain movement of a portion of a locking pin when disposed therein.

26. The mat as recited in claim 21, wherein the sloped incline of said at least one attachment edge is disposed along said inner surface of said first layer and said second layer.

27. The mat as recited in claim 26, said sloped incline further comprising a notch dimensioned to receive a corresponding notch in an opposing said first layer or said second layer for fitting engagement of said first layer and said second layer.

28. The mat as recited in claim 21, wherein said first layer and said second layer each comprise an inner surface and an oppositely disposed outer surface, and wherein said first layer and said second layer are affixed at said inner surfaces.

29. The mat as recited in claim 28, wherein said inner surfaces of said first layer and said second layer comprise a reinforcing structure integrally formed in and extending substantially the full thickness of said first layer or said second layer.

30. The mat as recited in claim 29, wherein said reinforcing structure comprises at least one reinforcing rib integrally formed in and extending substantially the full thickness of said first layer or said second layer.

31. The mat as recited in claim 30, further comprising a plurality of reinforcing ribs disposed in a strengthening configuration.

32. The mat as recited in claim 31, wherein said reinforcing structure further comprises at least one space defined between at least two of said plurality of reinforcing ribs.

33. The mat as recited in claim 30, wherein said plurality of reinforcing ribs are disposed in intersecting relation to one another.

34. The mat as recited in claim 29, wherein said reinforcing structure of said first layer matingly corresponds with said reinforcing structure of said second layer.

35. The mat as recited in claim 28, wherein said outer surfaces of said first layer and said second layer comprise a plurality of traction elements.

36. The mat as recited in claim 35, wherein said outer surfaces of said first layer and said second layer comprise different grades of traction elements.

37. The mat as recited in claim 36, wherein said first layer comprises industrial grade traction elements.

38. The mat as recited in claim 36, wherein said first layer comprises pedestrian grade traction elements.

39. A method of forming the modular mat as recited in claim 28, comprising hot welding said inner surface of said first layer to said inner surface of said second layer.

40. A method of forming the modular mat as recited in claim 21, comprising hot welding the first layer and second layer together.

* * * * *